US008567480B2

(12) United States Patent
d'Hone et al.

(10) Patent No.: US 8,567,480 B2
(45) Date of Patent: Oct. 29, 2013

(54) METHOD AND TWIN ROLL CASTER FOR THE PRODUCTION OF STRIP CAST FROM A MOLTEN METAL

(75) Inventors: André d'Hone, Krefeld (DE); René Leenen, Willich (DE)

(73) Assignee: Outokumpu Nirosta GmbH, Krefeld (DE)

( * ) Notice: Subject to any disclaimer, the term of this patent is extended or adjusted under 35 U.S.C. 154(b) by 0 days.

(21) Appl. No.: 12/918,150

(22) PCT Filed: Feb. 20, 2009

(86) PCT No.: PCT/EP2009/052061

§ 371 (c)(1),
(2), (4) Date: Oct. 27, 2010

(87) PCT Pub. No.: WO2009/103799

PCT Pub. Date: Aug. 27, 2009

(65) Prior Publication Data

US 2011/0031644 A1 Feb. 10, 2011

(30) Foreign Application Priority Data

Feb. 22, 2008 (DE) ..... 10 2008 010 689

(51) Int. Cl.
*B22D 11/06* (2006.01)

(52) U.S. Cl.
USPC ..... 164/428; 164/480

(58) Field of Classification Search
USPC ..... 164/428, 480
See application file for complete search history.

(56) References Cited

U.S. PATENT DOCUMENTS

| | | | | |
|---|---|---|---|---|
| 4,456,052 | A | 6/1984 | Kawakami | |
| 5,188,166 | A | 2/1993 | Perry | |
| 6,296,046 | B1 * | 10/2001 | Jeong et al. | 164/452 |

FOREIGN PATENT DOCUMENTS

| | | | |
|---|---|---|---|
| EP | 0031133 | B1 | 2/1983 |
| JP | 3174954 | A | 7/1991 |
| JP | 5237603 | A | 9/1993 |
| JP | 00117397 | A | 4/2000 |
| WO | 04000487 | A1 | 12/2003 |

* cited by examiner

*Primary Examiner* — Kevin P Kerns
(74) *Attorney, Agent, or Firm* — The Webb Law Firm

(57) ABSTRACT

A twin roll caster and a method for operating a machine of this type. The machine includes two casting rolls, that delimit a casting gap between them on its longitudinal sides; two side plates that delimit the casting gap on its narrow sides; and at least one oscillation device, which moves the side plate in an oscillating manner about an axis of oscillation, extending substantially axially parallel to the axes of rotation of the casting rolls. Oscillation device includes two actuators, which are articulatedly coupled to the one side plate and each apply a torque rotating about the axis of oscillation on the one side plate, and a control device that emits control signals, upon which the actuators, individually or together with each other, carry out adjustment movements aligned against one another or parallel to one another.

15 Claims, 3 Drawing Sheets

METHOD AND TWIN ROLL CASTER FOR THE PRODUCTION OF STRIP CAST FROM A MOLTEN METAL

BACKGROUND OF THE INVENTION

When casting strip according to the twin roll casting process, the oppositely-rotating casting rolls of the caster delimit the longitudinal sides of the casting gap. On its narrow sides, however, the casting gap is sealed by a side plate in each case.

The side plates are usually comprised of an insert and a support plate, which bears the insert. The insert in this case is usually made from refractory material and is formed so that it partly covers the front sides, associated with it, of the casting rolls and completely covers the narrow side, to be delimited by it, of the casting gap.

The relative movements, necessary in the casting process, between the side plates and the front sides of the casting rolls as well as the contact with the molten mass moving through the casting gap inevitably lead to wear of the side plate due to abrasive wear. This is particularly true if the contact between the side plates and the molten mass or the casting rolls is realised by means of an insert made from refractory material.

In order that, in the case of side plates equipped with such inserts, it is ensured that the side plates perfectly fulfil their sealing function also at the start of the casting process, it is necessary to grind in the inserts before the casting process begins. For this purpose the respective side plate is adjusted while the casting rolls are rotating until the inserts of the respective side plate lie with the required contact pressure against the respective associated front sides of the casting rolls. Thereupon abrasive wear of the insert material occurs in the region of the contact surfaces.

This condition is maintained until the casting rolls are ground in to a certain required depth into the refractory material of the insert and the insert lies closely fitting against the front sides of the casting roll. The inserts of the side plates now have one section, the so-called "positive insert", projecting into the casting gap, and two sections, the so-called "insert grinding surfaces", adjacent thereto, springing back in relation to the positive insert, with which sections they lie against the front sides of the casting rolls. Here the positive insert with its lateral edge surfaces covers a narrow margin, adjacent to the respective casting roll front side, of the peripheral face of the casting rolls in each case.

Corresponding to the cross-sectional shape, determined by the casting roll form, of the casting gap, the width of the positive inserts in the casting direction reduces continuously following the peripheral radius of the casting rolls, while the insert grinding surfaces are usually dimensioned so that their width remains uniform over the entire arc of contact with the casting rolls.

Because the side plates, possibly by means of their respective insert, are in direct frictional contact with the cooled casting rolls in the casting process, heat is constantly removed from them. Therefore, during the casting process, the temperature of the side plates is usually lower than the temperature of the molten mass coming into contact with them. Consequently heat is also removed from the molten mass when it touches the side plates. The heat loss in this case can be so great that molten mass solidifies on the respective positive insert. In the case of side plates equipped with an insert made from refractory material, this heat loss takes place particularly in the region of the positive inserts.

Such solidifications, in technical parlance also known as "parasitic solidifications", form in practice particularly in the lower third, seen in the casting direction, of the tapering part of the positive insert. Furthermore parasitic solidifications can also form in the region of the so-called triple points at which the respective side plate insert, the respective casting roll and the bath surface of the molten mass flowing through the casting gap converge. The places where the solidifications form are usually equally distributed on both side plates.

Whether parasitic solidifications actually form depends on various factors. Thus the quality of the molten mass that is to be cast (melting range, solidification enthalpy, nucleating agents etc.) is paramount in determining the tendency to form parasitic solidifications. The formation of parasitic solidifications is also affected by the free space available above the bath surface level of the casting gap up to the cover of the casting gap and the vertical lowering means and mould levels contingent thereon.

Moreover the temperature distribution in the side plates or their inserts has substantial influence on the formation of parasitic solidifications. This depends firstly on the axial and vertical speeds at which the side plate is moved. Secondly the temperature distribution depends on the material of the inserts and on the currents which can arise near the inserts and are determined by the distance of the immersion nozzle, through which the molten mass is fed into the casting gap, from the insert as well as the kinetic energy of the molten mass entering the casting gap.

Parasitic solidifications can cause strip defects, such as thickness discontinuities (deviation from defined tolerances), insufficient through-solidification (bulging aspects) and material tears (strip edges). In extreme cases they may require the casting process to be aborted.

A further manifestation of the wear on the inserts of the side plates results as a consequence of strip shells forming on the cooled casting rolls during the strip casting process. Increased material wear occurs due to the relatively high strength of these strip shells along the casting roll arc of contact. This material wear leads to the formation of a gap between the particular casting roll and the insert associated with it, whose width (growth and swarming of the strip shell) and depth (erosion=casting material strength and/or corrosion=casting material analytics) increase starting from the level of the molten mass cast into the casting gap towards the narrowest roll distance.

At the corresponding size, the gap formed in the insert by the removal of material promotes the formation of so-called "T-edges", which are flanked by molten mass, so that the insert and the respective solidifying strip shell can become positively clamped together. As a consequence of the contraction, accompanying the solidification of the molten mass, of the strip width, tensions can then occur in the strip, which tensions become so great that the strip tears in the longitudinal direction. Such longitudinal tearing may also require the casting to be aborted.

It is known that wear of the insert due to contact with solidifying molten mass can be reduced by moving the insert during the casting process in a precisely pre-determined way relative to the molten mass that is to be cast. For this purpose the side plates are oscillated rotationally about a centrally arranged axis. With this rotational oscillation it is equally possible to counteract solidifications in the lower third of the insert and to counteract the wear increasing downwards. Examples of this procedure are described in Japanese Patents JP 03-174954, JP 05-237603 or U.S. Pat. No. 5,188,166.

Common to the known possibilities of minimising wear by oscillation, however, is the disadvantage that in the case of rotational oscillation the fulcrum of the oscillation cannot be shifted or, in the case of horizontal oscillation of this movement, no rotational movement can be superimposed. A shift of the fulcrum may, however, then be necessary in the case of rotational oscillation, for example if the level of the surface of the bath is varied. Likewise a shift of the fulcrum may be necessary in the horizontal direction if higher-strength or more chemically aggressive materials, materials with different solidification behaviour, materials with varying viscosities and not least different casting thicknesses are to be produced.

A further disadvantage of the rotation about a certain central axis, used in the state of the art described above, is that lowering the inserts is only possible to a limited extent, since here the fulcrum is shifted in or against the casting direction. Such lowering, however, is expressly recommended for example in WO 04/000487 (EP 1 515 813 B1) for minimising wear or in U.S. Pat. No. 6,296,046 for aligning the insert lower edge with the so-called "kissing point", at which the strip shells solidified on the peripheral surfaces of the casting rolls are pressed against one another.

In order to ensure mobility of the side plates proposed in each case, so-called "supporting structures" are employed in practice. These usually comprise a support frame. This bears the adjustment devices needed for adjusting the position of the side plate in the way proposed in each case. Here the support frame can be held in guides, in which it is adjustably mounted in a horizontal and/or vertical direction and can be supported in relation to the firm substrate, on which the particular caster stands (WO 04/000487).

SUMMARY OF THE INVENTION

Against the background of the state of the art described above, the object of the invention was to create a twin roll caster and indicate a method whereby, in a simple manner, the degrees of freedom of the side plate movements carried out in the casting process for minimising wear and optimising the casting result are increased in relation to the possibilities existing in the state of the art.

Regarding the twin roll caster, the solution of this object is achieved by virtue of the fact that a machine of this type is configured according to the invention in the way indicated in claim 1. Advantageous variants and refinements of a twin roll caster according to the invention are indicated in the claims referring back to claim 1.

An inventive twin roll caster, equipped with two casting rolls that delimit a casting gap between them on its longitudinal sides, and two side plates that delimit the casting gap on its narrow sides, comprises, just like the state of the art, at least one oscillation device, which is associated with one of the side plates and moves the side plate concerned, during the casting process, in an oscillating manner about an axis of oscillation extending substantially axially parallel to the axes of rotation of the casting rolls.

Now according to the invention the oscillation device comprises two actuators, which are articulatedly coupled to the respective side plate and during operation each apply a torque rotating about the respective axis of oscillation on the side plate. By means of the actuators provided by the invention, the oscillating movements taking place about the axis of oscillation can be varied over a wide spectrum. Thus the actuators can not only move the side plate associated with them by a raising and lowering taking place in the opposite direction each time by the same distance about an axis of oscillation fixed with regard to its position, but it is also easily possible, by varying the individual adjustment movements carried out by the actuators, to constantly change the position of the axis of oscillation in the casting process.

In this case, by vertical oscillation in the opposite direction, a rotational oscillation form can be created, as proposed for example in JP 03-174954 and JP 05-237603, whereby the danger of the formation of undesired solidifications in the lower region of the side plate or its insert can be minimised and the insert wear can be reduced.

Because in a mode of operation, one of the actuators is arrested while the other actuator carries out adjustment movements, it is also possible to use the respective arrested actuator as a counter bearing for the adjustment movements carried out by the other actuator. In this case the respective side plate can for example be swiveled in a pendulum fashion about an axis of oscillation, which coincides with the axis of rotation of one of the casting rolls. This form of oscillating movement was recommended for example in U.S. Pat. No. 5,188,166 in order to avoid undesired solidifications in the upper region of the side plate.

Likewise, undesired solidifications in the upper section of the respective side plate can be minimised by oscillation in the same direction, as proposed for example by JP 2000-117397.

Also, in the case of an inventive device, the side plate can be lowered if required by lowering the actuators in the same direction in order to exploit the possibility of minimising wear indicated in EP 1 515 813 B1.

A further advantage of the inventive use of two actuators, articulatedly coupled to the respective side plate and each independently operable, consists in that the fulcrum can be quasi shifted along with vertical lowering. All oscillation and lifting movements can also be carried out in combination here. Vertical oscillation in the opposite direction in conjunction with vertical oscillation in the same direction and vertical lowering results in strong relative movements in the lower third and in the triple point region.

In the end the invention, through the use of two actuators independent of one another with respect to the adjustment movements carried out by them, permits maximum freedom in the adjustment of the side plate. Due to the adjustment possibilities proposed by the invention, in the case of a twin roll caster according to the invention, the movements carried out during the casting process of the respective side plates can always be easily performed in such a way that the danger of the formation of parasitic solidifications and the wear of the side plates and in particular the inserts carried by them are reduced to a minimum.

According to the inventive method, therefore, the actuators, as a function of the wear pattern existing on the respective side plate, are optionally operated individually or together.

The simplicity of their construction and the independence of the actuators from one another can produce the necessary oscillating movements of the side plates particularly simply here in terms of control engineering. Accordingly a twin roll caster according to the invention also has a control device that emits control signals, upon which the actuators carry out adjustment movements aligned against one another or parallel to one another. This control device can as far as possible be freely programmed depending on individual requirements, and in the process configured such that it undertakes the adjustment of the respective side plate on the basis of empirically compiled values stored in a memory or data obtained online about the respective wear condition. Of course it is also possible to configure the control device in terms of a self-tutoring or self-correcting system such that, in it, the empirical values are constantly corrected under consideration of condition data obtained online and vice-versa.

In accordance with one practical embodiment of the invention, the joints, by means of which the actuators are coupled to the side plate, are arranged on different sides of the axis of oscillation. Such coupling of the side plate to the actuators permits large excursions of the oscillating movement with short adjustment distances of the actuators. In practice this can be realised by fastening the side plate to a crosspiece and by coupling the one of the actuators articulatedly to the one end section, seen in the longitudinal direction, of the crosspiece and the other actuator to the opposite end section of the crosspiece.

A particularly compactly constructed and at the same time—from a kinematic aspect—simple inventive twin roll caster is characterised in that the effective directions of force of the actuators are aligned parallel to one another.

Since the cast strip usually leaves the casting gap of a twin roll caster in vertical alignment, thus the casting direction being vertically aligned, in the predominant number of applications it will be expedient to vertically align the effective directions of force of the actuators. In this way the vertical displacement of the side plate that is to be carried out, if required, for minimising wear can be performed in a particularly simple way.

Moreover it is advantageous with respect to simple construction on the one hand and uniform loading of the actuators on the other hand, if the effective directions of force of the actuators are aligned parallel to one another.

As actuators used in the inventive way, hydraulically-operated adjusting cylinders, for example, come into consideration, which are able with minimum space requirement to carry out rapid adjustment movements with the necessary display of force. In this connection it has been shown to be particularly advantageous if the adjusting cylinders used as actuators in the inventive way are supported hydrostatically. Such support is namely capable of absorbing the transverse forces which may occur in the casting process due to the axial adjustment of the side plates necessary for close contact of the respective side plate on the front sides, associated with it, of the casting rolls.

Alternatively or additionally to the hydrostatic support of the actuators, other measures may also be proposed for arresting the axial forces produced by the axial, that is to say into the casting gap, guided in a direction axially parallel to the axes of rotation of the casting rolls, feed rate of the side plates. Thus a supporting linkage can also be provided for this purpose, as shown in EP 0 031 133 B1, for example.

A particularly stable embodiment of an inventive caster results if the actuators are firmly connected to the substrate on which the twin roll caster stands. "Firmly" in this sense implies that the actuator, without interposing an additional joint, stands on the respective substrate. Regardless thereof the actuator can naturally be coupled to the side plate by means of a suitable joint, in order to be able to produce the respective oscillating movement.

The axial variations in length possibly occurring through vertical displacement of the side plate are negligible from experience and can be compensated by a corresponding axial adjustment. In order to compensate for axial play, a force-regulated servo-cylinder can be employed for example.

In order to be able in particular if the side plate is moved with the aid of two adjusting cylinders, to adjust the length variations or angular offsets possibly arising in the then necessary transmission, it may be expedient to couple at least one of the actuators to the side plate by means of a coupling device to compensate for an angular offset or length variation. A coupling device of this type can be realised in practice for example with the aid of a flexible and elastic connecting link, by means of which the respective actuator is coupled to the side plate. Likewise it is possible to compensate for length or angle by means of a coupling device which comprises a linear guide, which permits an additional relative movement between the side plate and the respective actuator at least in one direction transverse to the axis of rotation and to the adjustment direction of the actuator.

DESCRIPTION OF THE PREFERRED EMBODIMENTS

Figure 1:
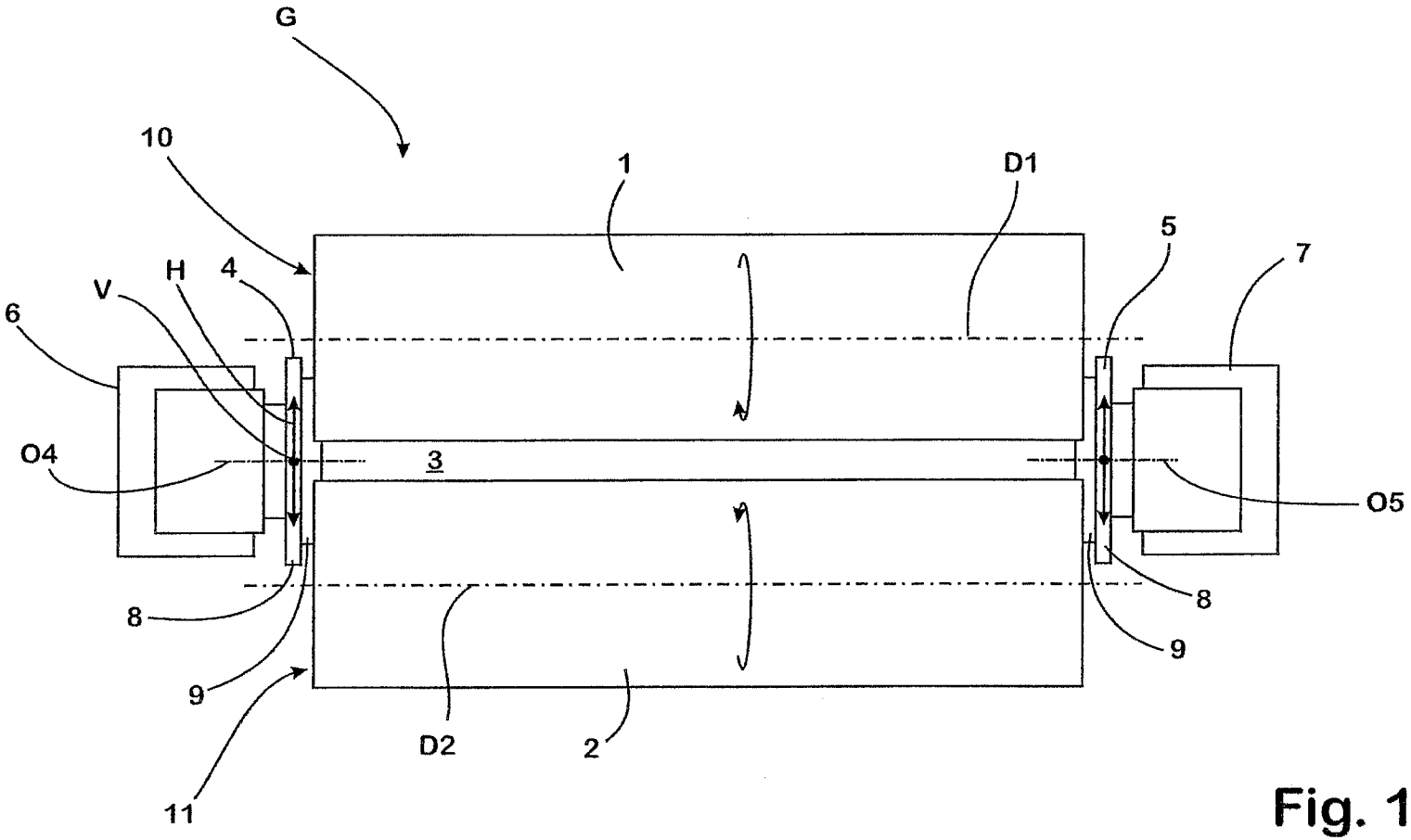
FIG. 1 is a twin roll casting device viewed from above.

The twin roll caster G has two casting rolls 1, 2, which each rotate in the opposite direction about a horizontally aligned axis of rotation D1, D2. The casting rolls 1, 2 delimit a casting gap 3 between them on its longitudinal sides.

On its narrow sides the casting gap 3 is sealed by a side plate 4, 5 in each case, which is respectively supported by an adjustment device. The adjustment devices each comprise a supporting structure 6, 7. The supporting structures 6, 7 each bear an oscillation device, which oscillates the side plate 4, 5 associated with it in each case, in the casting process about an axis of oscillation O4, O5 in each case.

The side plates 4, 5 each comprise a steel support plate 8, which on its side associated with the casting gap 3 bears an insert 9 made from a refractory material. The shape of the insert 9 is selected in such a way that it superimposes the front sides 10, 11, associated with it, of the casting rolls 1, 2 in each case in an insert grinding surface 12, 13 in the form of the arc of a circle.

The insert grinding surfaces 12, 13 have been ground in into the insert 9, over the course of a start-up process of the twin roll caster G carried out according to specific instructions after the respective side plate 4, 5 has been newly fitted with a new insert 9, by abrasive removal of material. They delimit between them a positive insert 14, freely projecting opposite them into the casting gap, which insert with its arc-shaped side surfaces 15*a*, 15*b* lies closely against the peripheral surface of the casting roll 1, 2 associated with the respective side surface 15*a*, 15*b*.

The supporting structures 6 or 7, associated with the side plates 4 or 5, are each formed identically.

Figure 2:
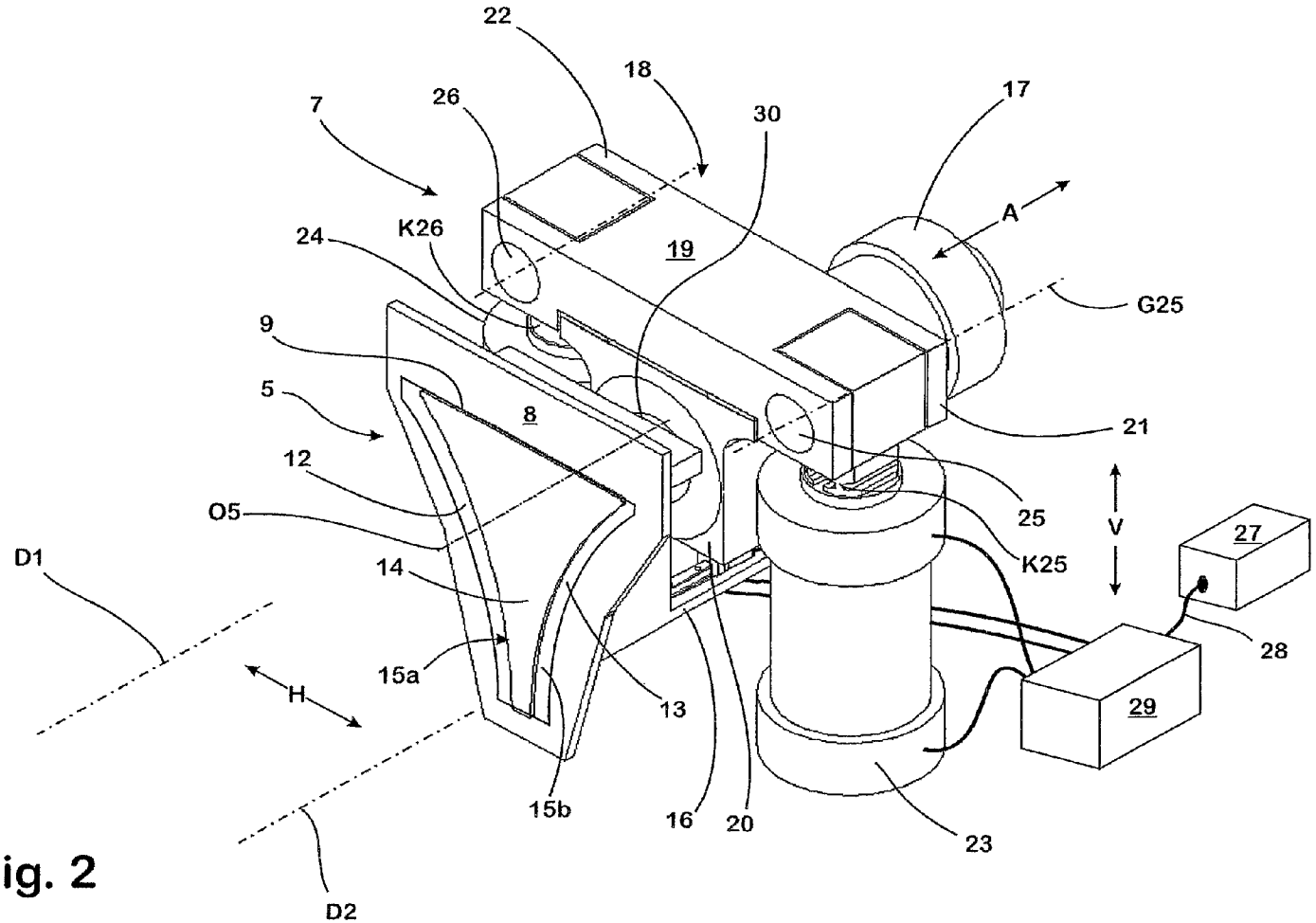
FIG. 2 is a perspective view of an adjustment device for a side plate used in the twin roll caster illustrated in FIG. 1.

As illustrated in FIG. 2 based on a possible embodiment of the adjustment device associated with the side plate 5, the supporting structure 7 in the case of this embodiment is displaceably mounted on a guide 16 in axial direction A of the axes of rotation D1, D2. An axial positioning cylinder 17 serving as axial actuator is provided for adjustment in axial direction A. During the casting process this holds the respective side plate 5 with its insert under a certain pre-determined pressure in contact with the respective front sides 10, 11 of the casting rolls 1, 2.

The axial positioning cylinder 17 in this case acts on a T-shaped support frame 18, which bears the side plate 5. The support frame 18 has an upper crosspiece 19 and a middle casing section 20 suspended thereon.

In each case a hydraulically-operable adjusting cylinder 23, 24 serving as actuator is articulatedly coupled to the free end sections 21, 22 of the crosspiece 19. The adjusting cylinders 23, 24, operable independently from one another, have a casing and a piston which is movable in the vertical direction, the piston shaft, guided out of the casing, of the piston being connected with its free end in each case by a joint 25, 26 to the end section 21 or 22 associated with it. Observed from above, the one adjusting cylinder 25 here is arranged on the one side and the other adjusting cylinder 26 on the other side of the axis of oscillation O5.

The adjusting cylinders 23, 24 with their end that is turned away from the respective joint 25, 26 firmly supported on the substrate supporting the twin roll caster G are each supported hydrostatically in order to be able to absorb the transverse forces possibly occurring during the adjustment, produced by the axial positioning cylinder 17, of the respective side plate 4, 5, in axial direction A, the transverse forces being directed into the casting gap 3, for example.

The adjusting cylinders 23, 24 form actuators, with the aid of which the respective side plate 4, 5 may be moved about its respective axis of oscillation O4, O5 in an oscillating manner. For this purpose the adjusting cylinders 23, 24, perform upwardly and downwardly aligned adjustment movements, for example each opposite to one another in the vertical direction V. Likewise for example the adjusting cylinder 23 can be arrested with its piston in a certain downward position, while the second adjusting cylinder 24 carries out further adjustment movements. The axis of oscillation O5 is thereby shifted to the axis G25 of the joint 25, in which joint the adjusting cylinder 21 is articulatedly coupled to the crosspiece 19. Moreover the adjusting cylinders 23, 24 can at the same time or sequentially perform a lowering movement aligned in the same direction, in order to lower the position of the axis of oscillation O5 in the vertical direction V. In order to compensate for angular offsets or length variations, caused by skewing of the crosspiece 19, between the joints 25, 26, the joints 25, 26 are each coupled, by means of coupling devices K25, K26 realised in the form of flexible bars, to the respective adjusting cylinder 23, 24. The coupling devices K25, K26 are aligned in such a way that, by corresponding buckling, they can compensate for variations in the distance between the free ends, supporting the joints 25, 26, of the pistons of the adjusting cylinders 23, 24 in the longitudinal direction of the crosspiece 19, which variations arise for example if the adjusting cylinders 23, 24 are moved in the opposite direction and the crosspiece 19 is moved from a straight horizontally aligned, unstressed position defining its original situation (FIG. 2) to a diagonally aligned position.

The adjusting cylinders 23, 24 move as a function of control signals from a control device 27, which are connected to the adjusting cylinders 23, 24 by means of corresponding control lines 28 and valve devices 29.

According to the control signals transmitted over the control lines 28, the valves of the valve devices 29 open or close, in order to retract or extend the pistons of the adjusting cylinders 23, 24 and accordingly swivel the side plate 5 via the crosspiece 19 into the one or other direction about the axis of oscillation O5.

The adjusting cylinders 23, 24 in this way together form actuators, which together with the control device associated with them and the valve device additionally provided where necessary as part of an oscillation device, move the side plate 5 in an oscillating manner.

The side plate 5 is coupled by means of a coupling device 30 to the front side, facing the casting rolls 1, 2, of the casing section 20. The coupling device 30 comprises a joint, not illustrated here, by means of which the axial positioning cylinder 17, serving as axial actuator, acts on the rear side of the side plate 5. The joint is provided to compensate for an angular offset between the normal plane relative to the effective direction of force applied by the axial actuator onto the respective side plate and the normal plane relative to the axes of rotation of the casting rolls. Since the joint proposed according to the invention is able to compensate for an offset between the alignment of the force applied by the axial actuator 17 and the axes of rotation D1, D2 of the casting rolls, it is ensured that the respective side plate 5 always lies with as far as possible homogeneous force distribution closely against the front sides 10, 11, associated with it, of the casting rolls 1, 2.

The joint thus permits tolerances, arising due to wear, structural inaccuracies and heat influences, in the distribution of the axial forces applied onto the respective side plate 4, 5 by the axial positioning cylinder 17 to be compensated. By means of the joint arranged according to the invention between the side plate 5, in each case to be subjected to the axial force, and the axial positioning cylinder 17 associated with it, it is namely achieved that the side plate 5, with its surface, associated with the casting rolls 1, 2, of the insert 9, also then always lies as far as possible uniformly against the casting roll front sides 10, 11, whenever locally different wear of the side plate 5 occurs as a consequence of material-related or process-related irregularities.

The casing section 20 of the support frame 8 is fastened to the crosspiece 19 by means of a sliding guide, not visible here. In the sliding guide the casing section may be moved in a horizontal direction H, aligned transversely to the axes of rotation D1, D2, relative to the crosspiece 19 and therefore also transversely to the guide 16 and the axes of rotation D1, D2 of the casting rolls 1, 2 by means of an adjusting cylinder, not visible here, serving as actuator for this direction of movement.

The sliding guide itself is suspended by means of two additional adjusting cylinders, likewise not illustrated here, on the crosspiece 19 of the support frame 18. These additional adjusting cylinders, likewise independently operable, together form an actuator, with which the casing section 20 and with it the respective side plate 5 can also again be moved in the vertical direction V relative to the crosspiece 19, in order to additionally superimpose a movement aligned in the vertical direction V onto the oscillating movement of the side plate 5. Observed from above here the one additional adjusting cylinder is arranged on the one side and the other additional adjusting cylinder on the other side of the axis of oscillation O5. In this way it is not only possible to adjust the side plate 5 by coordinated operation of the additional adjusting cylinders in a uniform movement in the direction V but, during asynchronous, alternating operation of the additional adjusting cylinders, to adjust the side plate 5 in the direction V step by step in a see-saw movement. The adjustment movement, carried out where necessary, of the additional adjusting cylinders is thereby superimposed onto the adjustment movements of the adjusting cylinders 23, 24.

Figure 3:
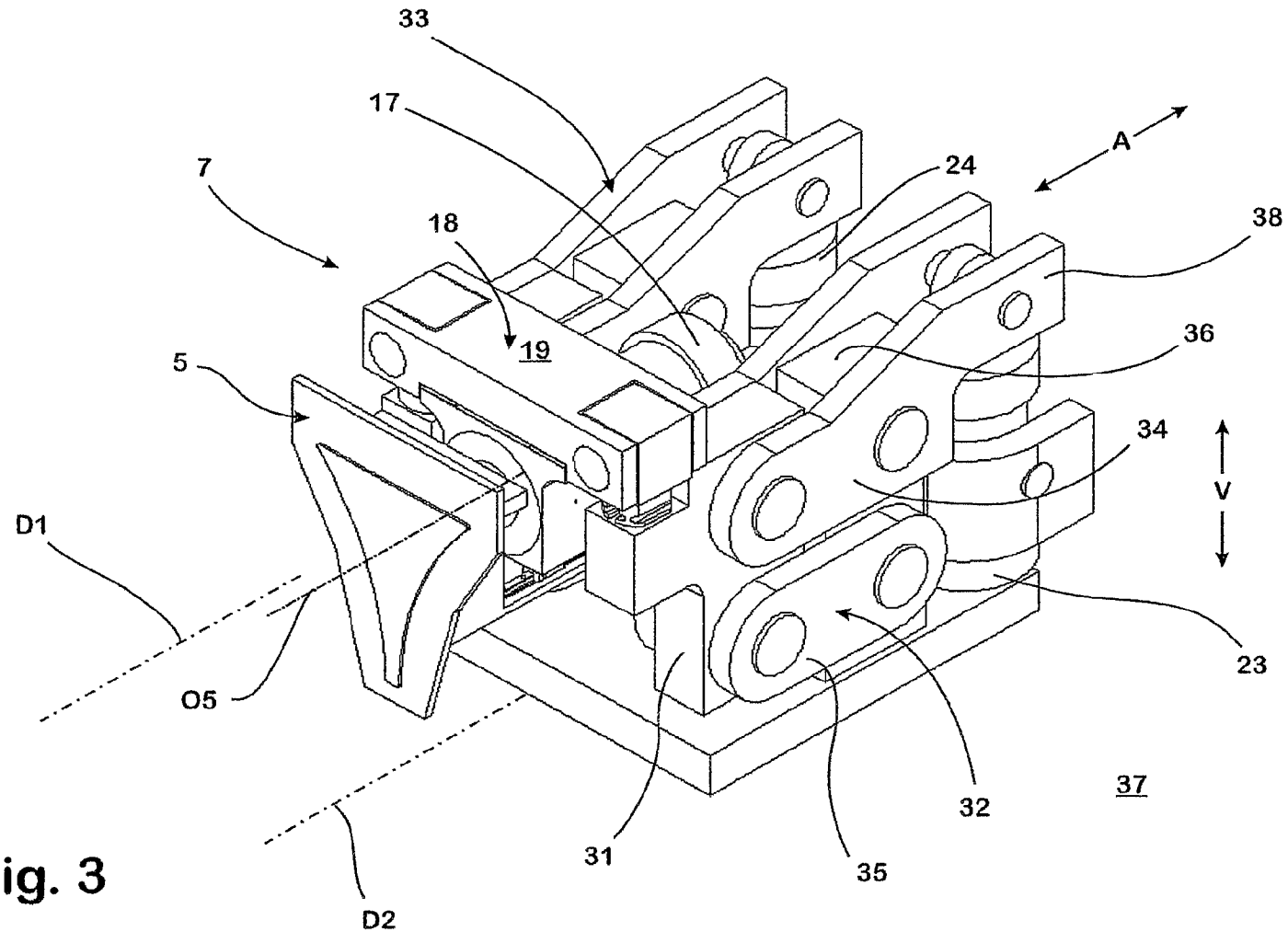
FIG. 3 is a perspective view of a second adjustment device for a side plate used in the twin roll caster illustrated in FIG. 1.

In contrast to the embodiment illustrated in FIG. 2 of an adjustment device associated with the side plate 5, in the case of the embodiment illustrated in FIG. 3 of an adjustment device of this type, the crosspiece 19 of the support frame 18 with its free end sections is each supported on a vertically aligned coupling member 31 of a parallelogram guide 32, 33 in each case. The parallelogram guides 32, 33 extend axially parallel to the adjustment axis A of the axial positioning cylinder 17 and the axes of rotation D1, D2. By these means the adjusting cylinders 23, 24 are articulatedly coupled to the end section, associated with them in each case, of the crosspiece 19.

The respective coupling member 31 of the parallelogram guides 32, 33 is articulatedly coupled to two horizontal struts 34, 35, which are again articulatedly coupled to a supporting member 36. The supporting member 36 is supported on the firm substrate 37, on which the twin roll caster G also stands. The connecting lines between the articulated axles of the joints of the coupling member 31 or of the supporting member 36 run just as parallel to one another as the connecting lines between the joints of the horizontal struts 34, 35.

The upper horizontal strut 34 of the one parallelogram guide 32 is extended out in a lever section 38 over the upper joint, associated with it, of the supporting member 36 and, with the free end of the lever section 38, is coupled to the free end of the piston of the adjusting cylinder 23. In the same way the upper horizontal strut of the other parallelogram guide 33 is coupled to the free end of the piston of the adjusting cylinder 24.

REFERENCE SYMBOLS

1, 2 casting rolls
3 casting gap
4, 5 side plates
6, 7 supporting structure
8 support plate
9 insert
10, 11 front sides of the casting rolls 1, 2
12, 13 insert grinding surfaces
14 positive insert
15*a*, 15*b* side surfaces
16 guide
17 axial positioning cylinder
18 T-shaped support frame
19 upper crosspiece of the support frame 18
20 middle casing section
21, 22 free end sections of the crosspiece 19
23, 24 adjusting cylinder
25, 26 joints
27 control device
28 control lines
29 valve devices
30 coupling device
31 coupling member
32, 33 parallelogram guides
34, 35 horizontal struts
36 supporting member
37 firm substrate
38 lever section
A axial direction of the axes of rotation D1, D2
D1, D2 axes of rotation of the casting rolls
G twin roll caster
G25 articulated axis of the joint 25
H horizontal direction of movement
O4, O5 axis of oscillation of the side plates 4, 5
V vertical direction of movement

The invention claimed is:

1. A twin roll caster comprising:

two casting rolls that delimit a casting gap between them on its longitudinal sides;

two side plates that delimit the casting gap on its narrow sides; and at least one oscillation device, which is/are associated with one of the side plates and rotates the one side plate, during the casting process, in a rotational oscillating manner about an axis of oscillation extending substantially axially parallel to the axes of rotation of the casting rolls, wherein the at least one oscillation device comprises:

two actuators, which, are articulatedly coupled to the one side plate and, during operation, each applying a torque rotating about the axis of oscillation on the one side plate; and a control device that emits control signals, upon which the actuators, individually or together with each other, carry out adjustment movements aligned against one another or parallel to one another.

2. The twin roll caster according to claim 1, wherein joints, by which the actuators are coupled to the side plate, are arranged on different sides of the axis of oscillation.

3. The twin roll caster according to claim 1, wherein effective directions of force of the actuators are aligned parallel to one another.

4. The twin roll caster according to claim 1, wherein effective directions of force of the actuators are aligned vertically.

5. The twin roll caster according to claim 1, wherein the respective actuator is configured as an adjusting cylinder.

6. The twin roll caster according to claim 5, wherein the adjusting cylinder operates hydraulically.

7. The twin roll caster according to claim 6, wherein the adjusting cylinder is supported hydrostatically.

8. The twin roll caster according to claim 1, wherein the actuators stand firmly on a substrate on which the twin roll caster is supported.

9. The twin roll caster according to claim 1, wherein at least one of the actuators is coupled to the side plate by a coupling device to compensate for an angular offset or a length variation.

10. The twin roll caster according to claim 9, wherein the coupling device comprises a flexible and elastic connecting link, by which the respective actuator is coupled to the side plate.

11. The twin roll caster according to claim 9, wherein the coupling device comprises a linear guide, which permits an additional relative movement between the side plate and the respective actuator at least in one direction transverse to the axis of oscillation and to an adjustment direction of the actuator.

12. A method for operating a twin roll caster configured according to claim 1, wherein the actuators, as a function of the wear pattern existing on the respective side plate, are optionally operated individually or together.

13. The method according to claim 12, wherein in the event of an individual operation of one actuator, the other actuator is arrested, so that it forms a counter bearing for the movements, performed thereupon by the respective side plate.

14. The method according to claim 12, wherein the respective side plate, as a function of the wear pattern existing on it in each case, is lowered in the casting direction by the actuators.

15. The method according to claim 14, wherein the lowering is in stages and is performed moving back and forth in a pendulum fashion between two turning points of oscillation of the respective side plate.

* * * * *